US009788662B1

(12) United States Patent
Hollett et al.

(10) Patent No.: US 9,788,662 B1
(45) Date of Patent: Oct. 17, 2017

(54) MULTI-FUNCTIONAL INFANT, BABY, AND TODDLER SEATING SYSTEM

(71) Applicants: Stephen Mark Hollett, Spartanburg, SC (US); Lisa Elaine Hollett, Spartanburg, SC (US)

(72) Inventors: Stephen Mark Hollett, Spartanburg, SC (US); Lisa Elaine Hollett, Spartanburg, SC (US)

( * ) Notice: Subject to any disclaimer, the term of this patent is extended or adjusted under 35 U.S.C. 154(b) by 0 days.

(21) Appl. No.: 15/015,063

(22) Filed: Feb. 3, 2016

Related U.S. Application Data

(60) Provisional application No. 62/111,477, filed on Feb. 3, 2015.

(51) Int. Cl.

| | |
|---|---|
| ***A47D 1/00*** | (2006.01) |
| ***A47D 11/02*** | (2006.01) |
| ***B60N 2/28*** | (2006.01) |
| ***A47D 15/00*** | (2006.01) |

(52) U.S. Cl.
CPC ..... *A47D 1/006* (2013.01); *A47D 11/02* (2013.01); *A47D 15/005* (2013.01); *B60N 2/2842* (2013.01)

(58) Field of Classification Search
CPC ..... A47D 1/006; A47D 11/02; A47D 15/005; A47C 11/00; B60N 2/2842
See application file for complete search history.

(56) References Cited

U.S. PATENT DOCUMENTS

| | | | | |
|---|---|---|---|---|
| 597,665 | A | 1/1898 | Andren | |
| 1,361,505 | A | 12/1920 | Snideman | |
| 1,389,940 | A | 9/1921 | Erbeau | |
| 2,050,667 | A | 8/1936 | Moreland | |
| 2,159,517 | A | 5/1939 | Beeman | |
| 2,560,708 | A | 7/1951 | Titus | |
| 2,731,072 | A * | 1/1956 | Post | A47D 1/00 248/188.5 |
| 2,994,557 | A | 8/1961 | King | |
| 3,203,731 | A | 8/1965 | Krueger | |
| 3,246,928 | A | 4/1966 | Haynes et al. | |
| 3,649,074 | A * | 3/1972 | McDonald | A47D 1/002 297/130 |
| 4,749,232 | A | 6/1988 | Guichon | |
| 5,087,097 | A | 2/1992 | Hehn | |
| 5,158,337 | A | 10/1992 | Leggett | |
| 5,183,311 | A | 2/1993 | Meeker et al. | |
| 5,248,181 | A | 9/1993 | Efthimiou | |
| 5,470,039 | A | 11/1995 | Hilger | |
| 5,688,024 | A | 11/1997 | Arizpe-Gilmore | |
| 6,010,184 | A * | 1/2000 | Lee | A47D 1/10 297/118 |
| 6,074,007 | A | 6/2000 | Helmsderfer et al. | |
| 6,082,814 | A * | 7/2000 | Celestina-Krevh | A47D 1/002 297/118 |

(Continued)

*Primary Examiner* — Philip Gabler
(74) *Attorney, Agent, or Firm* — Tillman Wright PLLC; James D. Wright; David R. Higgins

(57) ABSTRACT

A multi-functional infant, baby and toddler seating system characterized by two complementary components that can be used separately, yet simultaneously, for distinctly different infant, baby and toddler seating purposes, or the individual, but complementary components can be used uniquely together for yet another distinctly different means of seating babies and toddlers during meal time or other seating needs.

18 Claims, 13 Drawing Sheets

(56) References Cited

U.S. PATENT DOCUMENTS

| | | | | |
|---|---|---|---|---|
| 6,203,102 | B1 * | 3/2001 | Helmsderfer | A47D 1/10 297/118 |
| 6,224,148 | B1 * | 5/2001 | Lee | A47D 1/10 297/118 |
| 6,659,544 | B2 * | 12/2003 | Hollett | A47D 1/10 297/118 |
| 6,938,952 | B2 * | 9/2005 | Dauterive | A47D 1/004 297/1 |
| 7,673,934 | B2 * | 3/2010 | Bearup | A47D 1/002 297/130 |
| 8,162,390 | B2 * | 4/2012 | Zhong | A47D 1/006 297/130 |
| 2003/0098597 | A1 | 5/2003 | Hollett et al. | |
| 2005/0269849 | A1 * | 12/2005 | Mathis | A47D 1/08 297/250.1 |

* cited by examiner

75

95

MULTI-FUNCTIONAL INFANT, BABY, AND TODDLER SEATING SYSTEM

CROSS-REFERENCE TO RELATED APPLICATION

The present application is a U.S. nonprovisional patent application of, and claims priority under 35 U.S.C. §119(e) to, U.S. provisional patent application Ser. No. 62/111,477, filed Feb. 3, 2015, which provisional patent application is incorporated by reference herein.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE PRESENT INVENTION

Field of the Present Invention

The present invention relates generally to infant, baby and toddler seating devices and more specifically to a multi-functional infant, baby and toddler seating system that can be used for various seating purposes for an infant in an infant carrier, or babies and toddlers that need a highchair.

Background

When choosing to eat in a restaurant, children often play a pivotal role in the parent's decision on where a family dines. When parents and caregivers of young children, particularly infants, babies and toddlers, are certain their children are safe, comfortable, and out of harm's way during a meal in a restaurant, they tend to relax and have a more enjoyable dining experience, stay longer, spend more on the meals, and are more likely to return to the same restaurant for a similarly enjoyable dining experience. This is a primary reason why many quick-service and full-service restaurants are becoming increasingly aware that proper seating accommodations for young children, especially babies still in infant carriers, is essential to the profitability of their businesses.

The size and developmental stage of a child significantly determines which child seating device is most appropriate. For example, an infant is generally a baby of less than six months of age and has yet to develop the necessary physical and mental skills necessary to sit upright on its own, especially in a highchair. However, because some babies develop faster than other babies, some larger and more mentally alert babies can likely use a highchair. An array of child seating products available to restaurants, including, for example; "single-use highchairs," "dual-purpose highchairs," "infant carrier stands" and "infant carrier slings" (i.e., devices for babies still in infant carriers), and "booster seats" (i.e., devices for children typically older, larger, and more mature than toddlers). However, when any of aforementioned single-use child seating products or devices are occupied, such "single-use-at-a-time" products afford no extended or additional use for a restaurant while such a device is being utilized. Restaurants must also have adequate space and also the means to store all such various child seating devices in order to have the proper and safe seating accommodations for infants, babies, and toddlers.

When parents or caregivers visit a restaurant, the infant child often remains nestled within its infant carrier when brought into a dining establishment, leaving many parents to struggle with the decision of where to safely place the baby in the infant carrier. While the aforementioned infant carrier stands or infant carrier slings are readily available to restaurants, not all full-service or quick-service restaurants offer such devices and oftentimes the parents' choices of where to safely place the baby in the infant carrier are limited to placing the baby, in the infant carrier, on the top of the dining table, on the floor, on an adult-height dining chair, or wedged into a booth seat. Thus, the comfort level is not high for most of the parents that experience such a dilemma when dining out with their infant children. Furthermore, in order to attempt to accommodate a family with a baby that still requires an infant carrier, some restaurants will invert a traditional wooden highchair as a means to "hold" or "accommodate" the infant carrier (and baby), in spite of the fact that this practice is contrary to the intended use of traditional highchairs. Devices as illustrated in U.S. Pat. Nos. 5,248,181 and 5,470,039 respectively, are single-use devices intended for infant carriers only, and are available to restaurants.

Prior to becoming toddlers, babies typically outgrow the infant carrier stage and begin to possess the ability to sit upright on their own, but most babies and toddlers require the extra height and safety features afforded by a highchair to properly and safely reach the surface of a dining table to eat. Additionally, babies and toddlers require the containment, and restraint system, or safety belts, commonly associated with highchairs, as these are necessary means to keep babies and toddlers from falling out or climbing out of such a device. Dual-purpose child seating devices that are reconfigurable to hold an infant carrier and convert to hold a baby or a toddler are available to restaurants. Two such dual-purpose child seating devices are conveyed in U.S. Pat. Nos. 6,074,007 and 6,659,544. Booster seats, which are another child seating product readily available to restaurants and parents alike, are intended to be used by young children who are generally larger, older, and are more mentally and physically developed than toddlers. In the United States, established safety standards and requirements to pass such safety standards are defined differently for booster seats and for highchairs. Generally, most commonly available booster seats do not provide the same protection, enclosure, or the seat height needed to afford a capable baby or toddler the ability to reach and eat from a dining table, but rather, simply give a young child the nominal "boost" needed to reach and eat from a dining table. As such, young children able to safely use a booster seat do not typically require the containment and other safety elements commonly associated with a highchair for babies and toddlers. The device illustrated in U.S. Pat. No. 5,183,311 illustrates the seat height difference between what is needed for a baby or toddler able to use a highchair and the height generally needed for an older and larger child able to use a booster seat.

All of the various child seating devices currently available to restaurants are appreciated for their intended functions. However, the unique utility with the child seating products is directly associated with one particular child seating use at a time, even with the referenced dual-purpose child seating devices. In a restaurant setting, the limitation with such single-use child seating devices can attribute to longer wait times for family patrons, and in turn, can result in a reduction in repeat business for restaurants. Moreover, providing the various proper seating accommodations for babies, toddlers, and other young children can be rather costly for restaurants, as well as occupy an inordinate amount of storage space within the restaurant when three such different devices are not in use.

Parents with young children, particularly toddlers and babies in infant carriers, often prefer a booth when dining in a restaurant. Currently, many restaurants elect to place a baby or toddler in a highchair at the end of the booth table, which is generally in the aisle, amongst the busy foot traffic from wait staff and patrons alike. This is an undesirable scenario for the baby or toddler, parents, and restaurants alike because the baby or toddler is placed in such a location where the highchair could be bumped and possibly tipped over or something could be easily spilled or dropped on the baby or toddler by passersby. Therefore, restaurants would benefit from utilizing a booth-seating highchair device because the toddler would be amongst his/her caregivers sitting in the same restaurant booth, the toddler would be removed from harm's way of the restaurant aisle foot traffic, there would be more aisle space for restaurant patrons, there would be a very unlikely chance that a booth-seating highchair would be tipped over by passersby in the aisle, and also less opportunity for the toddler to disrupt surrounding restaurant patrons dining at tables or other booths in the restaurant. A child in a booth-seating highchair device would also be a part of the dining experience, and therefore, less likely to "act out" or feel disconnected from the rest of the family, otherwise resorting to loud and disruptive behavior to garner attention.

When the infant, baby, and toddler seating devices currently available to restaurants are being used, such devices afford no extra use for a second child when such a device is occupied. Additionally, when a restaurant has a limited supply of such "single-use-at-a-time" devices, restaurant patrons often have to wait for the appropriate seating device for an infant, baby, or toddler to become available. Alternatively, for example, if a restaurant has a limited supply of the infant carrier stands and such devices are occupied, the restaurant patron who needs the use of such a device for their infant child will often be offered an inverted toddler highchair to accommodate the infant in an infant carrier. This is an unfortunate, yet common scenario.

Accordingly, it is believed that a need exists for a multi-functional infant, baby, and toddler seating system which affords at least three distinctly different child seating uses from the same device. Moreover, it is believed that a need for such a seating device in which its individual components can be used together, or alternatively, used independently, yet, simultaneously for uniquely different infant, baby, and toddler seating needs exists. It is also believed that the aspects and features of the present invention accommodate such seating needs

SUMMARY OF THE PRESENT INVENTION

Broadly defined, the present invention according to one aspect is a multi-functional infant, baby and toddler seating system, including: a support structure stand, having a base for placement on a floor or ground surface, at least one integral riser extending upward from the base, a substantially horizontal support element, one or more barrier elements, wherein a containment area is defined within the support element and the barrier elements, and a first coupling structure, integral with or rigidly attached to the at least one integral riser, the support element, and/or the barrier element; and a seat assembly, having a frame, a seat and a backrest, and a second coupling structure, integral with or rigidly attached to the frame, seat, and/or backrest, and adapted to engage and couple securely with the first coupling structure; wherein, in a first state of use, the seat assembly is installed in the containment area of the support structure stand, thereby functioning as a highchair, such that the seat assembly is restrained from being dislodged by the one or more barrier elements, the first and second coupling structures are securely coupled together to retain the seat assembly in the containment area, and a baby or toddler is placed in the seat assembly; wherein, in a second state of use, the first and second coupling structures are uncoupled from one another and the seat assembly is removed from the support structure stand, an infant carrier is disposed in the containment area such that the infant carrier is restrained from being dislodged by the one or more barrier elements, and an infant is placed in the infant carrier; and wherein, in a third state of use, the first and second coupling structures are uncoupled from one another and the seat assembly is removed from the support structure stand, the seat assembly is placed on a restaurant booth seat surface or adult-height dining chair, and a baby or toddler is placed in the seat assembly.

In a feature of this aspect, a fourth state of use is provided in which the first and second coupling structures are uncoupled from one another, the seat assembly is removed from the support structure stand, an infant carrier is disposed in the containment area such that the infant carrier is restrained from being dislodged by the one or more barrier elements, the seat assembly is placed on a restaurant booth seat surface or adult-height dining chair, an infant is placed in the infant carrier, and a baby or toddler is placed in the seat assembly, such that the infant carrier and support structure stand are being used by the infant while simultaneously the seat assembly is being used by the baby or toddler.

In a further feature, the at least one integral riser reinforces the substantially horizontal support element.

In another further feature, the substantially horizontal support element receives and reinforces the placement of the seat assembly in the first state of use.

In another further feature, the substantially horizontal support element receives and reinforces the placement of the infant carrier in the second and fourth states of use.

In another further feature, the first and second coupling structures are latch elements.

In another further feature, the first and second coupling structures are groove structures that align with each other and retain the seat assembly when the groove structures of the seat assembly are slid into place with the groove structures of the support structure stand.

In another further feature, the seat assembly includes a waist and crotch safety restraint system that includes one or more straps.

In other further features, the seat assembly includes a frame extension assembly that includes a portion that is adjustable longitudinally so as to force the seat assembly against a seatback surface; and/or the adjustable portion of the frame extension assembly is adjustable longitudinally behind the seat frame so as to force the seat assembly forward from a seatback surface.

In other further features, the barrier element is situated to longitudinally abut at least one riser; the barrier element is situated to laterally abut at least one riser; the barrier element is situated to substantially circularly abut at least one riser; the barrier element is situated to longitudinally abut or be disposed above the substantially horizontal support element; the barrier element is situated to laterally abut or be disposed above the substantially horizontal support element; the barrier element is situated to substantially circularly abut or be disposed above the substantially horizontal support element; the barrier element is passive; and/or the barrier element is adjustable.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Further features, embodiments, and advantages of the present invention will become apparent from the following detailed description with reference to the drawings, wherein.

DETAILED DESCRIPTION

Figure 1:
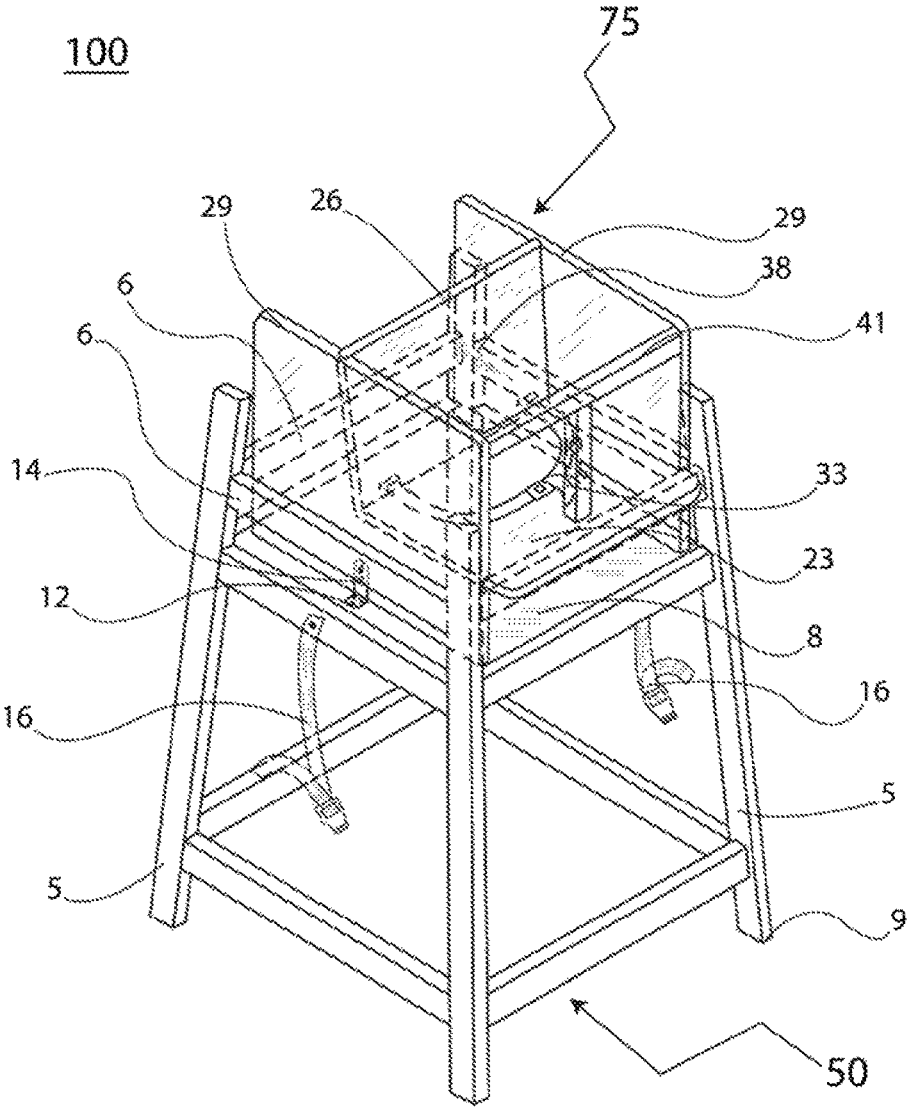
FIG. 1 is an isometric view of the multi-functional infant, baby, and toddler seating system in accordance with one or more preferred embodiments of the present invention.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. §112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers," "a picnic basket having crackers without cheese," and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, in which like numerals represent like components throughout the several views, one or more preferred embodiments of the present invention are next described. The following description of one or more preferred embodiment(s) is merely exemplary in nature and is in no way intended to limit the invention, its application, or uses.

FIG. 1 is an isometric view of a multi-functional infant, baby, and toddler seating system 100 in accordance with one or more preferred embodiments of the present invention. As shown therein, the system 100 includes a support structure stand 50 and a seat assembly 75, where the support structure stand 50 and seat assembly 75 are shown in a first state of use. The support structure stand 50 includes a base 9 for placement on a floor or ground surface, integral risers 5, which may be substantially vertical or may be somewhat angled, for reinforcing a substantially horizontal support element 8, a barrier element 6, a first coupling element 12, and an infant carrier safety restraint element 16, which can also be utilized as a barrier element. The seat assembly 75 includes a seat frame 29, a seat 23, and a backrest 26, a waist and crotch safety restraint system 33, a handle bar safety restraint element 41, and a second coupling element 14, and as perhaps best shown in FIG. 3*c*, one mechanical means of a seat assembly frame extension assembly 38 is placed on or approximate the substantially horizontal support element 8 and within the barrier element 6, of a containment area. As shown, the seating system 100 functions in a first state of use as a traditional style highchair.

It will be appreciated that the illustrated barrier element 6 (optionally including the infant carrier safety restraint element 16) is merely one example of a barrier element(s) suitable for use in various preferred embodiments of the present invention. A barrier element (including the illustrated barrier element 6) can be situated to longitudinally, laterally, or substantially circularly abut at least one riser 5; a barrier element (including the illustrated barrier element 6) can be situated to longitudinally, laterally, or substantially circularly abut or be disposed above the substantially horizontal support element 8; and/or a barrier element (including the illustrated barrier element 6) can be passive or adjustable. For example, the inventors have considered variations of a barrier element that comprises adjustable straps that can be affixed laterally in a similar means to the infant carrier restraint straps and buckle system 16, or longitudinally to at least one riser 5, or to abut or be disposed above the substantially horizontal support element 8. Alternatively, a barrier element (including the illustrated barrier element 6) can be a passive circular or oval structure made of a plastic material, a flexible, adjustable, and substantially circular structure made of a woven fabric, can be integrated with at least one riser 5, and/or can abut or be disposed above the substantially horizontal support element 8.

It will be apparent to the Ordinary Artisan that the arrangement illustrated in FIG. 1 is merely one preferred implementation of the system 100 described and illustrated herein. However, it will be appreciated that the seating system 100 of the present invention can be utilized with a variety of materials and designs. For example, the support structure stand 50, and the seat assembly 75 can be made to fold and become a compact and portable system, utilized in metal and fabric materials, plastic materials, or other suitable materials, or in combination of materials durable enough for the utility and integrity of the present invention; and the coupling of the support structure stand 50 with the seat assembly 75 can be accomplished by a number of feasible means as is necessary to securely mate the seat assembly 75 with the support structure stand 50.

With regard to the latter, it will be apparent that the first and second coupling elements 12,14 can be alternatively located elsewhere on multi-functional seating system 100. For example, the coupling elements 12,14 can be located on the front and rear of the support structure stand 50 and respectively on the front or rear of the seat assembly 75. The coupling elements 12,14 are conveniently delineated as a means for a latch system, but the inventors have contemplated a variety of feasible means adapted for coupling and decoupling or pairing and un-pairing the support structure stand 50 and seat assembly 75 of the multi-functional seating system 100. One example of an alternative means for coupling the support structure stand 50 with the seat assembly 75 is illustrated in FIG. 4*a*, wherein the seat assembly 75 has a male groove track 17 substantially near the base of the seat frame 29 and the support structure stand 50 has a female groove track 19 located approximate the substantially horizontal support element 8. When the male and female groove tracks 17,19 are mated, the seat assembly 75 and the support structure stand 50 are feasibly coupled in a secure means significantly different than the latch system of coupling elements 12,14. For the safety of the child utilizing seating system 100, methods to pair or mate the support structure stand 50 and seat assembly 75 such as the first and second coupling elements 12,14 or the groove track system 17,19 as depicted in the preferred embodiments, the mating or coupling of the support structure stand 50 with the seat assembly 75 should reasonably secure the components well enough to withstand rigorous movements of a rambunctious young child and also the repeated coupling and decoupling necessary for alternative states of use afforded by multi-functional seating system 100.

Figure 2:
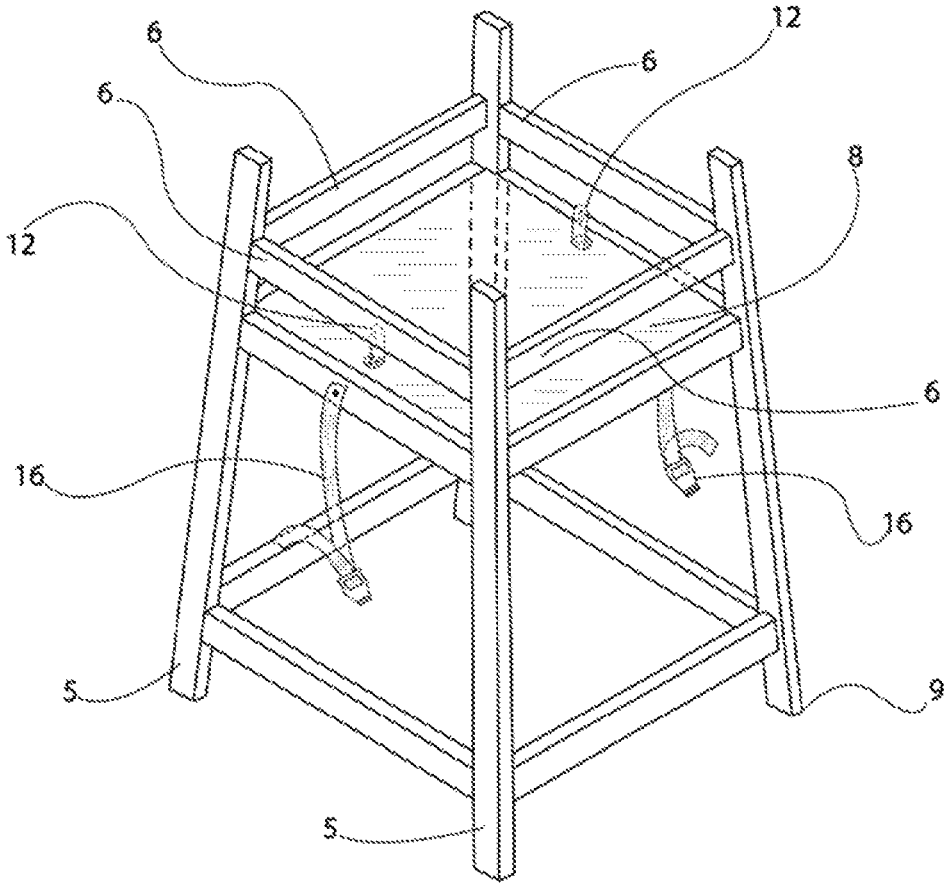
FIG. 2 is an isometric view of the support structure stand of the multi-functional seating system of FIG. 1.

FIG. 2 is an isometric view of the support structure stand 50 of the multi-functional seating system 100 of FIG. 1. The support structure stand 50 comprises a base 9 for placement, adaptation, or use on a floor or ground surface, at least one integral riser 5 for reinforcing a substantially horizontal support element 8, one or more barrier elements 6, a first feasible means of a coupling element 12, and an infant carrier safety restraint element 16, which as described further hereinbelow can further assist as a barrier element with the confinement of an infant carrier 95, such as an infant car seat, when placed on or approximate to the substantially horizontal support element 8 of the containment area when used with the support structure stand 50. The support element 8 and barrier elements 6 form a containment area.

Figure 3A:
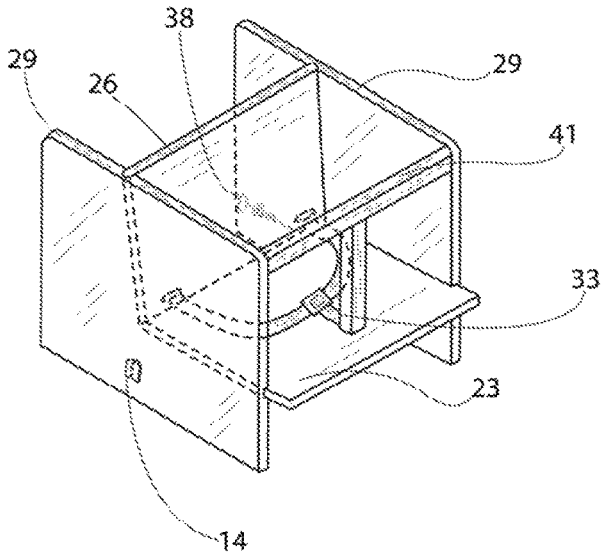
FIG. 3*a* is a front isometric view of the seat assembly of the multi-functional seating system of FIG. 1.
Figure 3B:
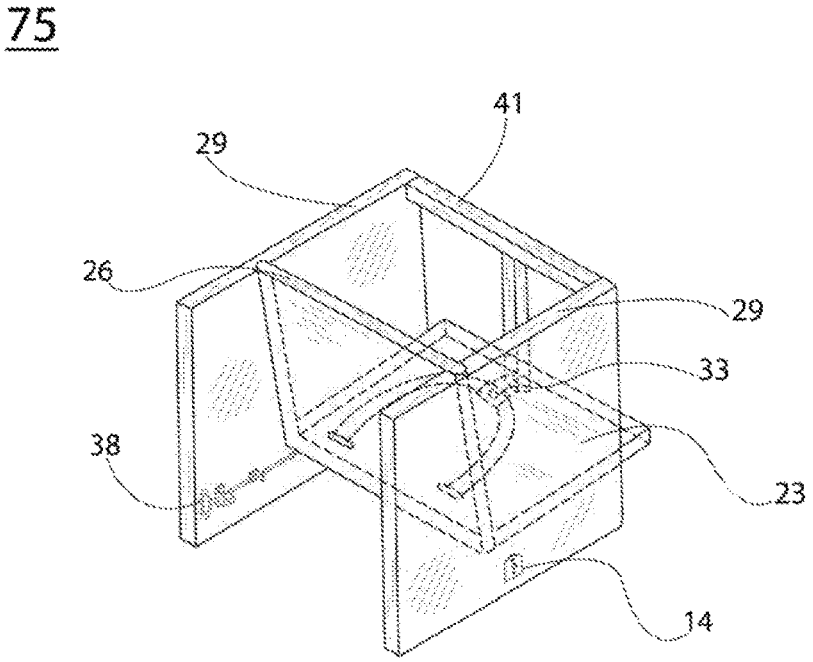
FIG. 3*b* is a rear isometric view of the seat assembly of the multi-functional seating system of FIG. 1.
Figure 3C:
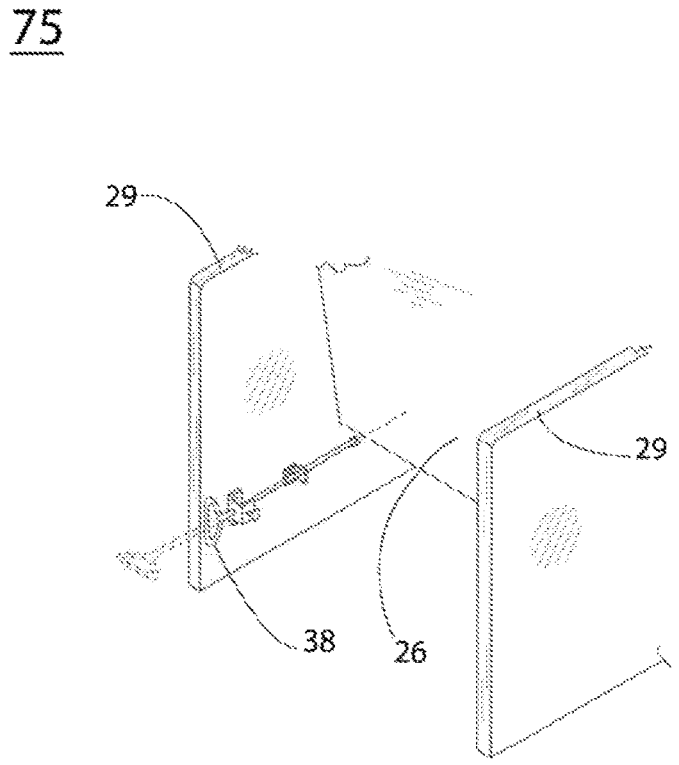
FIG. 3*c* is a fragmentary rear isometric view of the seat assembly of the multi-functional seating system of FIG. 1.

FIGS. 3*a*-3*c* are a front isometric view, a rear isometric view, and a fragmentary rear isometric view, respectively, of the seat assembly 75 of the multi-functional seating system 100 of FIG. 1. As shown therein, the seat assembly 75 comprises the seat frame 29, the seat 23, and the backrest 26, as well as a waist and crotch safety restraint system 33, a handle bar safety restraint element 41, and a feasible means of a second coupling element 14, which in conjunction with a feasible means of a first coupling element 12 together become a latch system. The waist and crotch safety restraint system 33 preferably includes a strap assembly, and a center crotch restraint, preferably connected to the handle bar safety restraint element 41, may be used to separate a child's legs from one another, thereby further aiding in restraining the child in place.

Distinctions between a booster seat, which is typically the seating device used by young children who are generally larger and more mature than children who still require the use of a highchair while eating from a dining table, include, for example, the protection elements such as a leg or crotch safety restraint system 33 and handle bar safety restraint element 41 of the seat assembly 75. Additionally, safety standards established in the United States for booster seats are uniquely different from those for highchairs. As such, young children able to safely use a booster seat do not typically require the containment and other safety elements commonly associated with a highchair for babies and toddlers. The seat assembly 75 can be used for at least two distinctly different highchair seating needs. When the seat assembly 75 is placed on or approximate the substantially horizontal support element 8 and within the barrier element 6 of the containment area of support structure stand 50, and the first and second coupling elements 12,14 are mated, the union of the support structure stand 50 and the seat assembly 75 functions as a traditional style highchair. In a distinctly different state of use, seat assembly 75 can alternatively be used as a baby and toddler highchair when placed on a restaurant booth seat surface as delineated in FIGS. 6-8 as described further hereinbelow.

Figure 4:
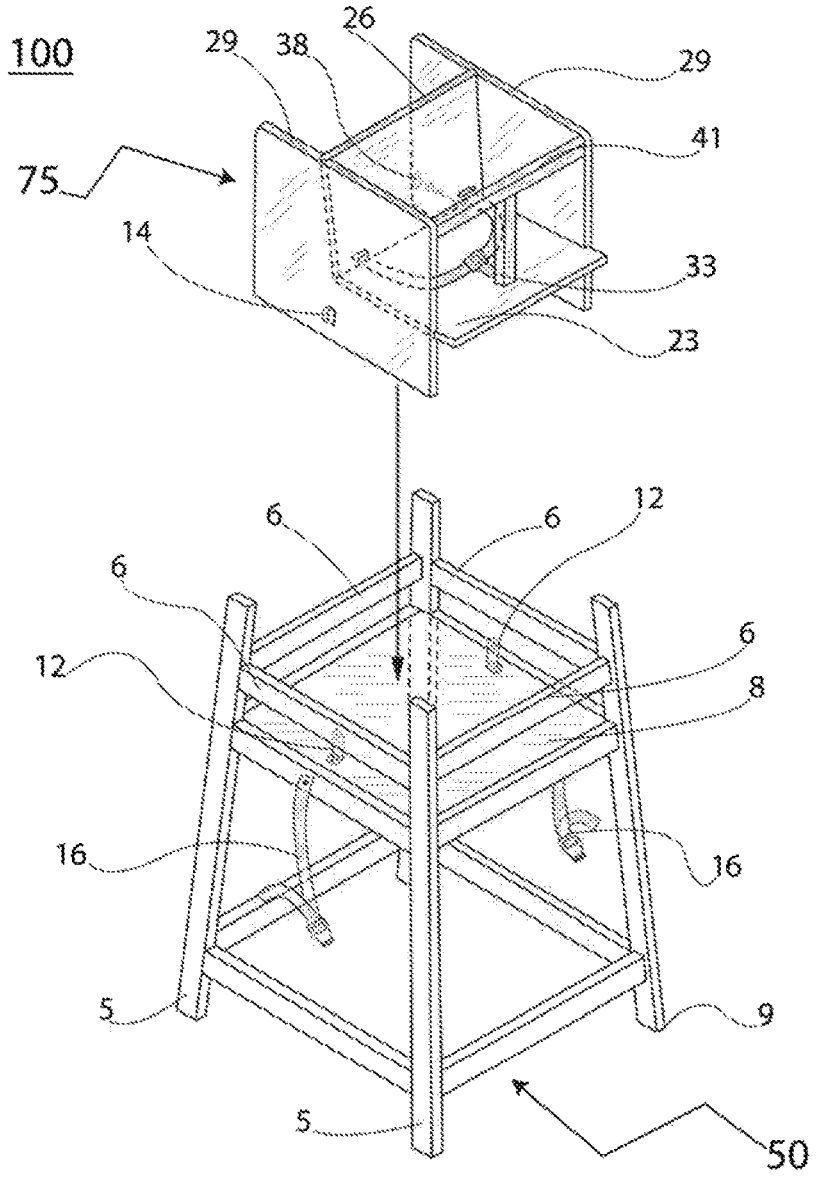
FIG. 4 is an isometric view of the seat assembly being placed onto the support structure stand of the multi-functional seating system of FIG. 1.
Figure 4A:
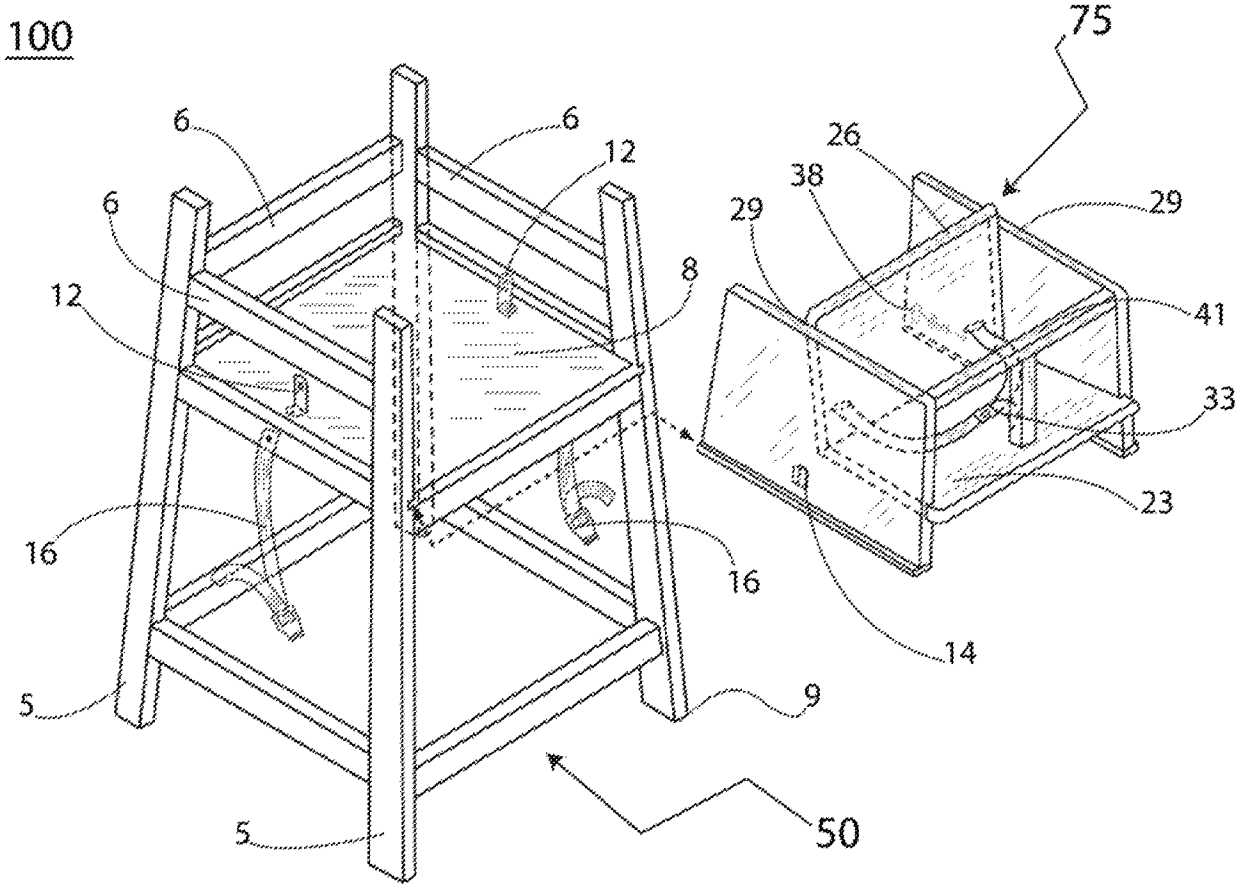
FIG. 4*a* is an exploded isometric view of the multi-functional seating system of FIG. 1 illustrating a groove system for alternatively coupling the seat assembly to the support structure stand.

FIG. 4 is an isometric view of the seat assembly 75 being placed onto or approximate the support structure stand 50 of the multi-functional seating system 100 of FIG. 1. More particularly, in FIG. 4, the seat assembly 75 is being placed into the containment area formed by the substantially horizontal support element 8 and the barrier elements 6. When the seat assembly 75 is positioned on or approximate the substantially horizontal support element 8 and substantially within the barrier elements 6, the first and second coupling elements 12,14 can either automatically engage, or may be engaged with the assistance of the adult caregiver depending on the complexity of the feasible means for the appropriate coupling elements. FIG. 4*a* is an exploded isometric view of the multi-functional seating system 100 of FIG. 1 illustrating the groove system described previously for alternatively coupling the seat assembly 75 to the support structure stand 50. When the male groove track 17 on the seat assembly 75 and the female groove track 19 on the support structure stand 50 are coupled, the seating system 100 is securely mated. Moreover, when the seat assembly 75 is mated with the support structure stand 50, the seat assembly 75 is situated substantially within the barrier elements 6 of the support structure stand 50, thereby safely pairing the support structure stand 50 with the seat assembly 75 for the first state of use as a baby or toddler highchair.

Figure 5A:
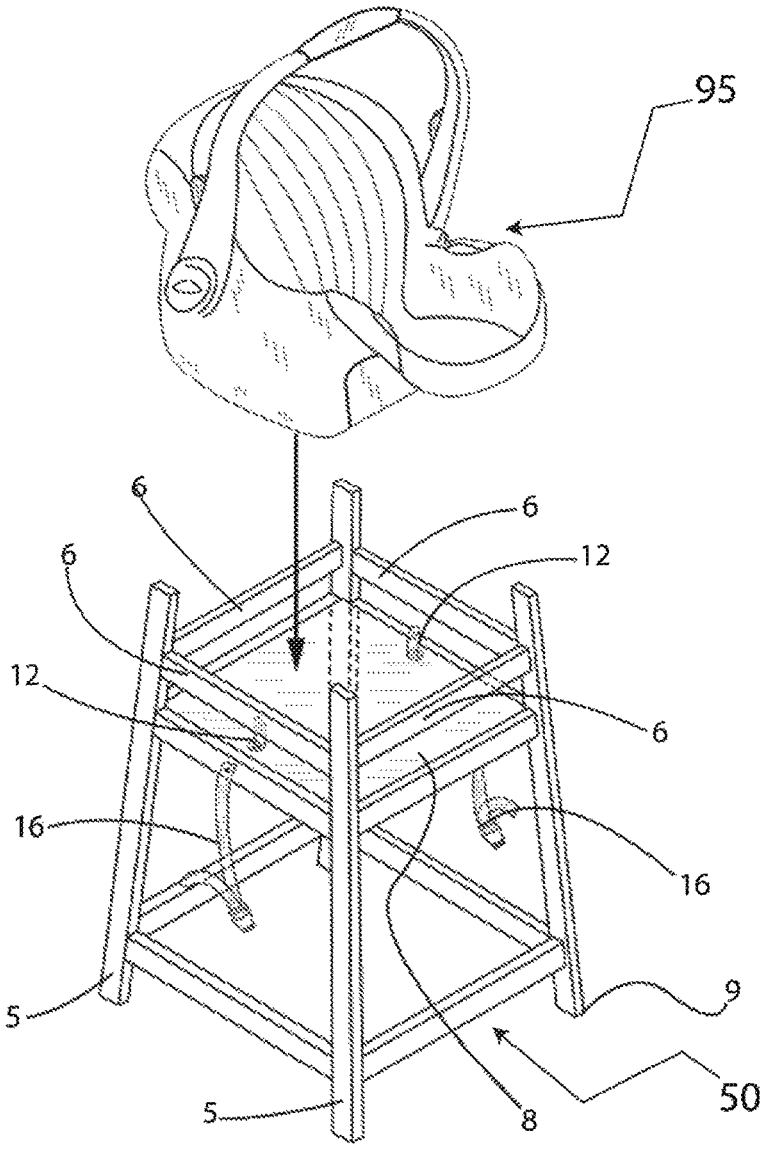
FIG. 5*a* is an isometric view of a conventional infant carrier being placed onto the support structure stand of the multi-functional seating system of FIG. 1.
Figure 5B:
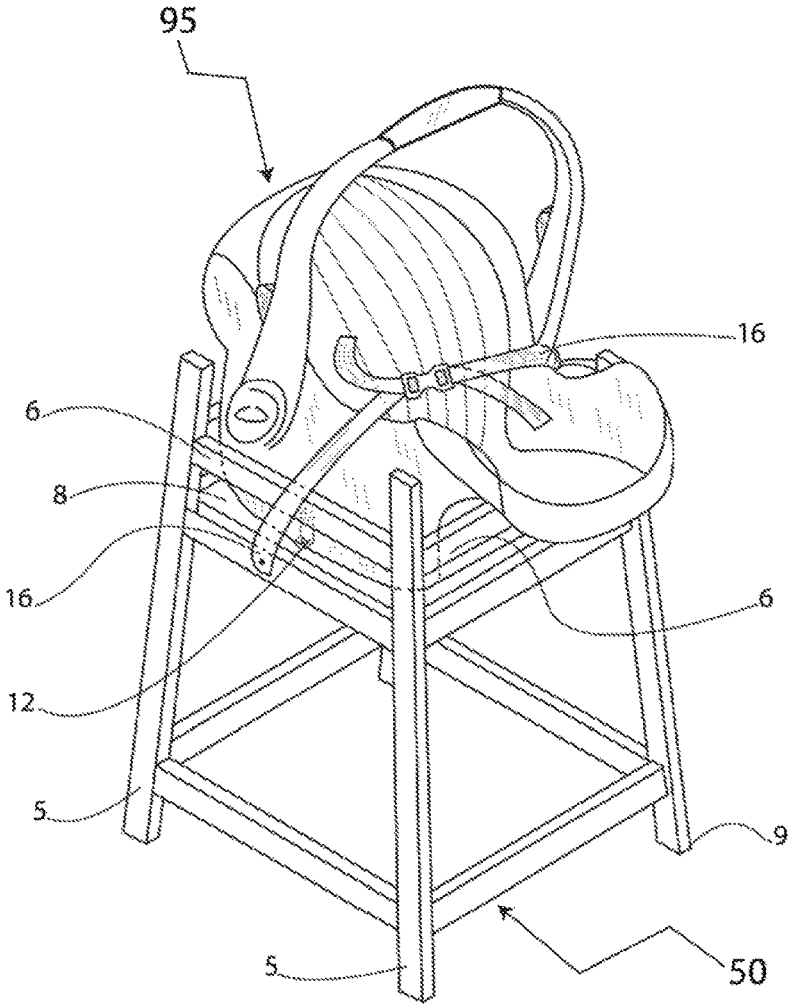
FIG. 5*b* is an isometric view of the infant carrier and support structure stand of FIG. 5*a*, illustrating a second state of use wherein the infant carrier is positioned on the support structure stand.

When the seat assembly 75 is decoupled from the first and second coupling elements 12,14 or 17,19 and removed from the support structure stand 50, an infant carrier 95 holding an infant baby (not illustrated) can be placed onto the support structure stand 50, thereby providing a second state of use. In this regard, FIG. 5*a* is an isometric view of a conventional infant carrier 95 being placed onto the support structure stand 50 of the multi-functional seating system 100 of FIG. 1, and FIG. 5*b* is an isometric view of the infant carrier 95 positioned and supported on the support structure stand 50 of the multi-functional seating system 100 of FIG. 1. As shown in FIG. 5*a*, the infant carrier 95 can be placed into the containment area, onto or approximate the substantially horizontal support element 8 and within the barrier elements 6, so that it is disposed and secured as shown in FIG. 5*b*. In such a state of use, the support structure stand 50 of the subject invention is used as an infant carrier stand as shown in FIG. 5*b* while the seat assembly 75 can be simultaneously used as a booth-seating highchair as delineated in FIGS. 6-8, or alternatively can be used as a highchair when strapped to a standard adult-height dining chair.

Figure 6:
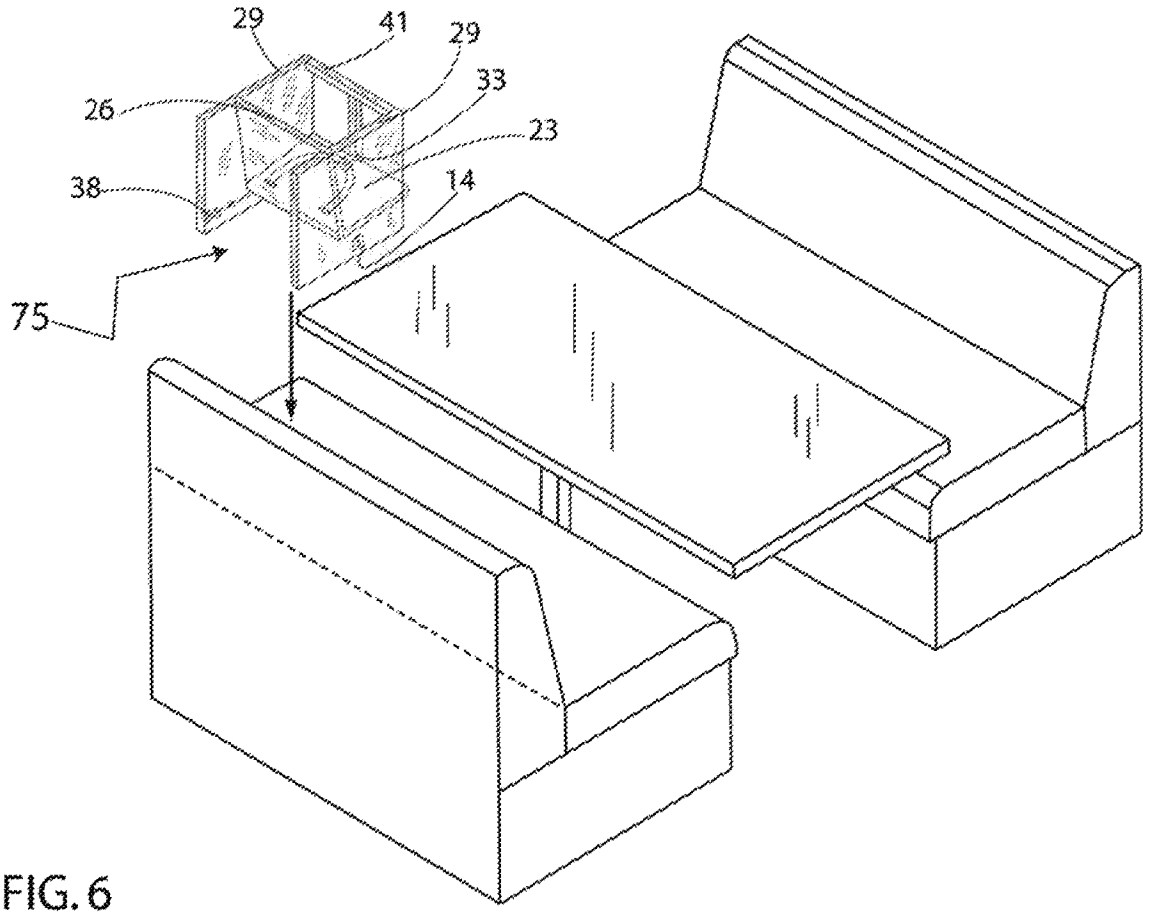
FIG. 6 is an isometric view of the seat assembly of the multi-functional seating system of FIG. 1 being placed onto a restaurant booth seat surface.
Figure 7:
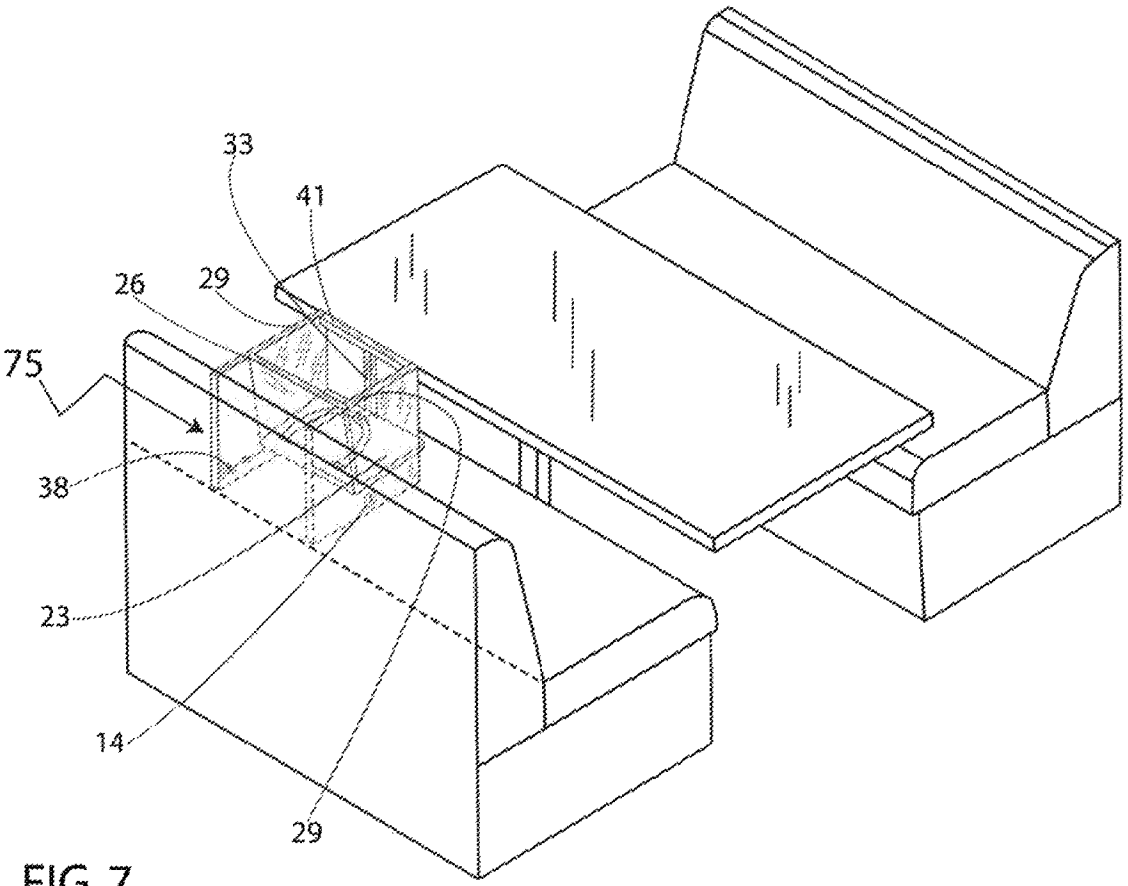
FIG. 7 is an isometric view of the seat assembly and restaurant booth of FIG. 6, illustrating a third state of use in which the seat assembly is positioned on the restaurant booth seat surface and abuts the edge of the restaurant booth table.

In a third state of use, the seat assembly 75 may be used, independently from the support structure stand 50, in a restaurant booth. In this regard, FIG. 6 is an isometric view of the seat assembly 75 of the multi-functional seating system 100 of FIG. 1 being placed onto a restaurant booth seat surface, and FIG. 7 is an isometric view of the seat assembly 75 and restaurant booth of FIG. 6, illustrating a third state of use in which the seat assembly 75 is positioned on the restaurant booth seat surface and abuts the edge of the restaurant booth table.

Notably, some restaurant booths have nonstandard seating dimensions. As perhaps best shown in FIG. 3*c*, the seat assembly 75 preferably includes a feasible means of a frame extension assembly 38. The frame extension assembly 38 aids in extending the depth of the seat frame 29 of seat assembly 75 in a longitudinal direction when the seat assembly 75 is used as a baby and toddler highchair in a restaurant booth seat with larger and deeper dimensions than the standard booth seat dimensions. The frame extension assembly 38 includes a portion that is arranged to abut a booth seatback surface or the like at an adjustable distance behind the seat frame 29 so as to force the seat frame toward the table. A better fit with larger restaurant booths can thus be provided by extending the seat frame 29 longitudinally, thereby making the seat assembly 75 deeper. The frame extension assembly 38 can be located on the rear of seat assembly 75 (as shown in FIGS. 3*a*-3*c*), on the front of seat assembly 75, or on both the front and rear locations of seat assembly 75, and can be of various materials, methods, designs feasible for extending the frame extension assembly 38 of seat assembly 75 in a longitudinal direction.

Figure 8:
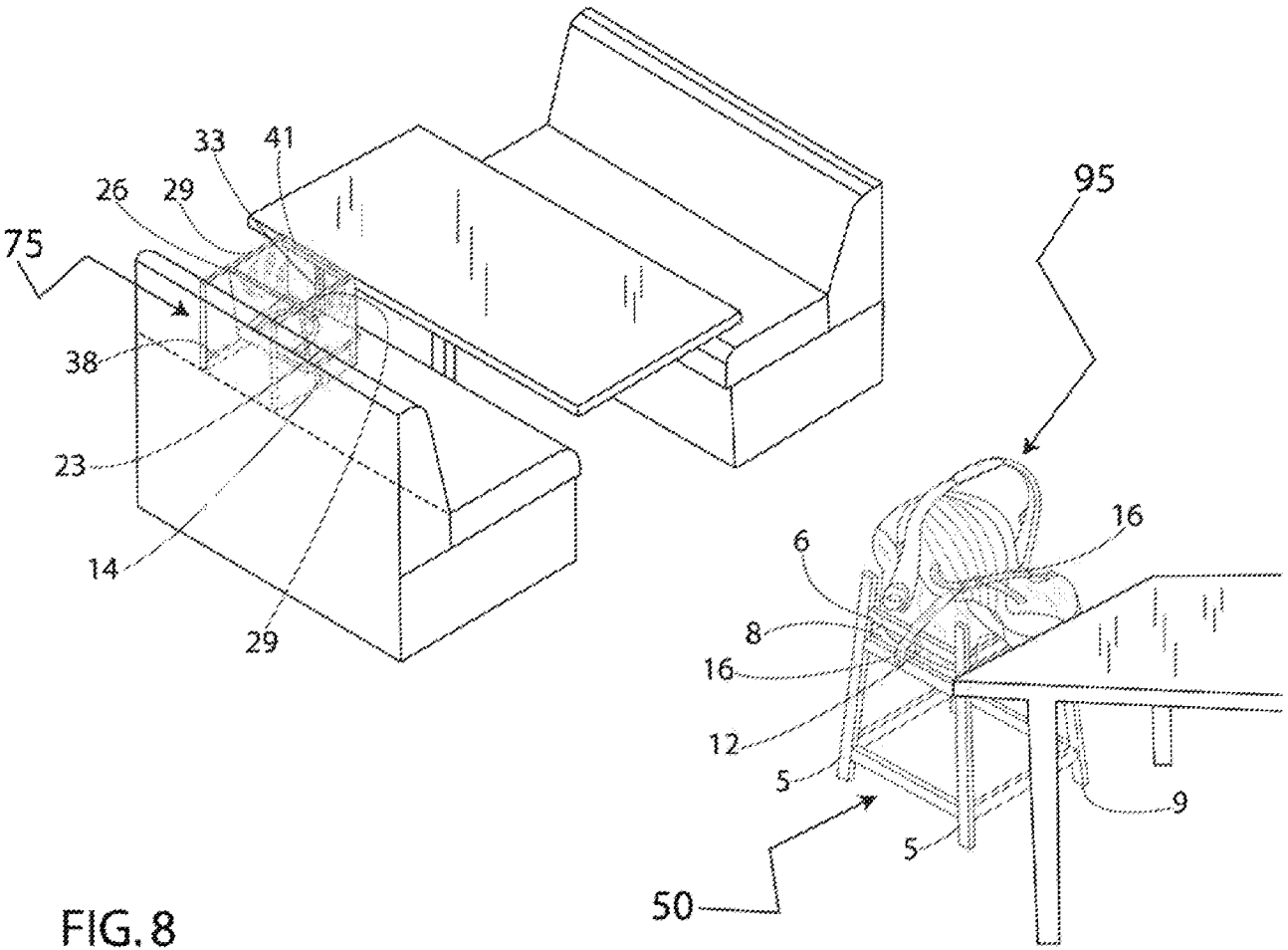
FIG. 8 is an isometric view of the multi-functional seating system of FIG. 1, illustrating a fourth state of use wherein the seat assembly is positioned on a restaurant booth seat surface and an infant carrier is simultaneously positioned on the support structure stand.
Figure 9:
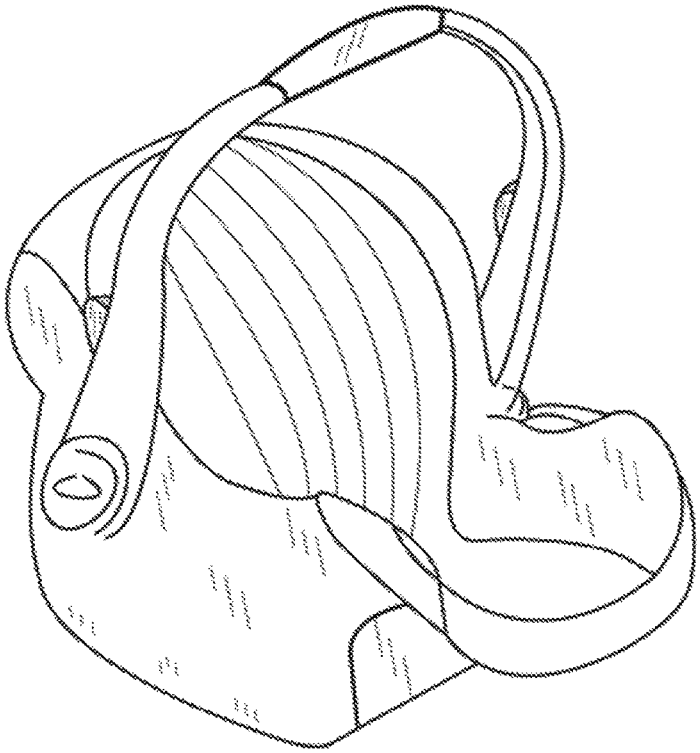
FIG. 9 is a perspective view of a commonly used style of infant carrier.

An important benefit and value of the present invention to restaurants is that two children with two different seating needs can use the multi-functional infant, baby, and toddler seating system 100 at the same time, as delineated in FIG. 8, thereby affording a restaurant a more cost effective and efficient children's seating device. In this regard, FIG. 8 is an isometric view of the multi-functional seating system 100 of FIG. 1, illustrating a fourth state of use wherein the seat assembly 75 is positioned on a restaurant booth seat surface and an infant carrier 95 is simultaneously positioned on the support structure stand 50. Parents or caregivers with limited kitchen or dining room space are afforded a similar benefit from the multi-functional infant, baby, and toddler seating system 100 when feeding an infant, baby, or toddler in the home by placing an infant baby in its infant carrier on or approximate the substantially horizontal support element 8 and within the barrier element 6 of the containment area of support structure stand 50, and also by using the seat assembly 75 as a highchair when strapped to a standard adult-height dining chair. Additionally, the seat assembly 75 is ideally small enough for parents or caregivers to bring the seat assembly 75 into a restaurant or other travel location where a highchair will be needed. A foldable and portable offering of the multi-functional infant, baby, and toddler seating system 100 will be of particular use to parents or caregivers when traveling with young children who require different seating needs.

Advantageously, restaurants will benefit from purchasing the system 100 of the present invention as a multi-purpose device, which will save restaurants money, be much easier to stow, afford families with an infant, baby, or toddler less of a wait time, and will likely reduce liability exposure brought about by not having or using the proper infant, baby and toddler seating devices. Restaurant patrons with young children are deserving of the proper and appropriate infant, baby and toddler seating accommodations to be able to dine without undue concern for their young child's safety while seated in such a public dining establishment.

Furthermore, young families who do not have homes with spacious dining rooms or eating areas in or near the kitchen will also benefit from one multi-purpose device that affords a growing family the ability to seat children with distinctly different seating needs at the same dining table at the same time. Therefore, with regard to the present invention, when a family includes both an infant that is still in need of an infant carrier and a baby or toddler that is able to safely use a highchair, parents and caregivers can seat both children at the same dining table at the same time by using the support structure stand as an infant carrier stand 50 and the seat assembly 75 as a baby and toddler highchair when strapped to an adult-height dining chair.

Based on the foregoing information, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention being limited only by the claims appended hereto and the equivalents thereof.

What is claimed is:

1. A multi-functional infant, baby and toddler seating system comprising:

(a) a support structure stand, including:

(i) a base for placement on a floor or ground surface, (ii) at least one integral riser extending upward from the base, (iii) a substantially horizontal support platform forming a shelf having a periphery, (iv) at least one barrier element arranged at an elevation above the shelf, wherein a containment area is defined by the support platform and the peripheral barrier elements such that the containment area has sides defined by the at least one barrier element, a bottom defined by the shelf formed by the support platform, and an open top, and (v) a first interlocking structure, integral with or rigidly attached to, but distinct from, one or more of the at least one integral riser, the support platform, and the at least one barrier element; and (b) a seat assembly, including:

(i) a frame, a seat and a backrest, and (ii) a second interlocking structure, integral with or rigidly attached to one or more of the frame, seat, and backrest, and adapted to engage and connect securely with the first interlocking structure;

(c) wherein, in a first state of use:

(i) the seat assembly is installed on the support platform in the containment area of the support structure stand, thereby functioning as a highchair, such that the seat assembly rests on, and is supported by, the support platform and is restrained from being dislodged by the at least one barrier element, (ii) the first and second interlocking structures are securely fastened together to retain the seat assembly on the support platform and in the containment area, and (iii) the seat assembly is adapted to receive a baby or toddler therein;

(d) wherein, in a second state of use:

(i) the first and second interlocking structures are unfastened from one another and the seat assembly is removed from the support structure stand, (ii) an infant carrier is disposed in the containment area such that the infant carrier rests on, and is supported by, the support platform and is restrained from being dislodged by the at least one barrier element, and (iii) the infant carrier is adapted to receive an infant therein; and (e) wherein, in a third state of use:

(i) the first and second interlocking structures are unfastened from one another and the seat assembly is removed from the support structure stand, (ii) the seat assembly is placed on a restaurant booth seat surface or adult-height dining chair, and (iii) while placed on the restaurant booth seat surface or adult-height dining chair, the seat assembly is adapted to receive a baby or toddler therein.

2. The multi-functional infant, baby and toddler seating system of claim 1, wherein, in a fourth state of use, the first and second interlocking structures are unfastened from one another, the seat assembly is removed from the support structure stand, an infant carrier is disposed in the containment area such that the infant carrier is restrained from being dislodged by the at least one barrier element, the seat assembly is simultaneously disposed on a restaurant booth seat surface or adult-height dining chair, the infant carrier is adapted to receive an infant therein, and the seat assembly is adapted to receive a baby or toddler therein, such that the infant carrier and support structure stand may be used by an infant while simultaneously the seat assembly is being used by a baby or toddler.

3. The multi-functional infant, baby and toddler seating system of claim 2, wherein the at least one integral riser reinforces the substantially horizontal support platform.

4. The multi-functional infant, baby and toddler seating system of claim 2, wherein the substantially horizontal support platform receives and reinforces the placement of the seat assembly in the first state of use.

5. The multi-functional infant, baby and toddler seating system of claim 2, wherein the substantially horizontal support platform receives and reinforces the placement of the infant carrier in the second and fourth states of use.

6. The multi-functional infant, baby and toddler seating system of claim 2, wherein the first and second interlocking structures are latch elements that together form a latch system for securing the seat assembly on the support platform.

7. The multi-functional infant, baby and toddler seating system of claim 6, wherein the first and second interlocking structures include a first fitting extending upward from the shelf and a corresponding second fitting disposed on a side of the seat assembly such that the first and second fittings align with each other and retain the seat assembly when the first fitting is slid into place with the second fitting.

8. The multi-functional infant, baby and toddler seating system of claim 2, wherein the seat assembly includes a waist and crotch safety restraint system that includes one or more straps.

9. The multi-functional infant, baby and toddler seating system of claim 2, wherein the seat assembly includes a frame extension assembly that includes a portion that is adjustable longitudinally so as to force the seat assembly against a seatback surface.

10. The multi-functional infant, baby and toddler seating system of claim 9, wherein the adjustable portion of the frame extension assembly is adjustable longitudinally behind the seat frame so as to force the seat assembly forward from a seatback surface.

11. The multi-functional infant, baby and toddler seating system of claim 2, wherein the at least one barrier element is situated to longitudinally abut at least one riser.

12. The multi-functional infant, baby and toddler seating system of claim 2, wherein the at least one barrier element is situated to laterally abut at least one riser.

13. The multi-functional infant, baby and toddler seating system of claim 2, wherein the at least one barrier element is situated to longitudinally abut or be disposed above the substantially horizontal support platform.

14. The multi-functional infant, baby and toddler seating system of claim 2, wherein the at least one barrier element is situated to laterally abut or be disposed above the substantially horizontal support platform.

15. The multi-functional infant, baby and toddler seating system of claim 2, wherein the at least one barrier element is passive.

16. The multi-functional infant, baby and toddler seating system of claim 2, wherein the at least one barrier element is adjustable to adapt to the size or position of the seat assembly or infant carrier when placed in the containment area.

17. A multi-functional infant, baby and toddler seating system comprising:

(a) a support structure stand, including:
- (i) a base for placement on a floor or ground surface,
- (ii) at least one integral riser extending upward from the base,
- (iii) a substantially horizontal support platform having a periphery,
- (iv) one or more barrier elements arranged to extend around substantially the entirety of the periphery of the platform at an elevation thereabove, wherein a containment area is defined by the support platform and the one or more peripheral barrier elements such that the containment area has sides defined by the one or more peripheral barrier elements, a bottom defined by the support platform, and an open top, and
- (v) a first interlocking structure, integral with or rigidly attached to one or more of the at least one integral riser, the support platform, and the one or more peripheral barrier elements; and (b) a seat assembly, including:
- (i) a frame, a seat and a backrest, and
- (ii) a second interlocking structure, integral with or rigidly attached to one or more of the frame, seat, and backrest, and adapted to engage and connect securely with the first interlocking structure;

(c) wherein, in a first state of use:
- (i) the seat assembly is installed on the support platform in the containment area of the support structure stand, thereby functioning as a highchair, such that the seat assembly rests on, and is supported by, the support platform and is restrained from being dislodged by the one or more barrier elements,
- (ii) the first and second interlocking structures are securely fastened together to retain the seat assembly in the containment area, and
- (iii) the seat assembly is adapted to receive a baby or toddler therein;

(d) wherein, in a second state of use:
- (i) the first and second interlocking structures are unfastened from one another and the seat assembly is removed from the support structure stand,
- (ii) an infant carrier is disposed on the support platform in the containment area such that the infant carrier rests on, and is supported by, the support platform and is restrained from being dislodged by the one or more barrier elements, and
- (iii) the infant carrier is adapted to receive an infant therein; and (e) wherein, in a third state of use:
- (i) the first and second interlocking structures are unfastened from one another and the seat assembly is removed from the support structure stand,
- (ii) the seat assembly is placed on a restaurant booth seat surface or adult-height dining chair, and
- (iii) while placed on the restaurant booth seat surface or adult-height dining chair, the seat assembly is adapted to receive a baby or toddler therein.

18. A multi-functional infant, baby and toddler seating system comprising:

(a) a support structure stand, including:
- (i) a base for placement on a floor or ground surface,
- (ii) at least one integral riser extending upward from the base,
- (iii) a substantially horizontal support platform,
- (iv) at least one barrier element arranged at an elevation above the support platform, wherein a containment area is defined by the support platform and the one or more barrier element such that the containment area has sides defined by the at least one barrier element, a bottom defined by the support platform, and an open top, and
- (v) a first interlocking structure, integral with or rigidly attached to one or more of the at least one integral riser, the support platform, and the at least one barrier element; and (b) a seat assembly, including:
- (i) a frame, a seat and a backrest, and
- (ii) a second interlocking structure, integral with or rigidly attached to one or more of the frame, seat, and backrest, and adapted to engage and connect securely with the first interlocking structure,
- (iii) wherein the frame includes a base having bottom surfaces that are arranged to be substantially horizontally co-planar with each other, and
- (iv) wherein the seat is elevated above the bottom surfaces of the base;

(c) wherein, in a first state of use:
- (i) the seat assembly is installed on the support platform in the containment area of the support structure stand, thereby functioning as a highchair, such that the seat assembly rests on, and is supported by, the support platform and is restrained from being dislodged by the at least one barrier element and wherein the seat is disposed at the same elevation as a top of the at least one barrier element, (ii) the first and second interlocking structures are securely fastened together to retain the seat assembly in the containment area, and (iii) the seat assembly is adapted to receive a baby or toddler therein;

(d) wherein, in a second state of use:

(i) the first and second interlocking structures are unfastened from one another and the seat assembly is removed from the support structure stand, (ii) an infant carrier is disposed on the support platform in the containment area such that the infant carrier rests on, and is supported by, the support platform and is restrained from being dislodged by the at least one barrier element, and (iii) the infant carrier is adapted to receive an infant therein; and (e) wherein, in a third state of use:

(i) the first and second interlocking structures are unfastened from one another and the seat assembly is removed from the support structure stand, (ii) the seat assembly is placed on a restaurant booth seat surface or adult-height dining chair, and (iii) while placed on the restaurant booth seat surface or adult-height dining chair, the seat assembly is adapted to receive a baby or toddler therein.

* * * * *